US008022284B1

(12) United States Patent
Velez Medicis

(10) Patent No.: US 8,022,284 B1
(45) Date of Patent: Sep. 20, 2011

(54) METHOD AND SYSTEM TO HARMONICALLY TUNE (JUST INTONATION TUNING) A DIGITAL / ELECTRIC PIANO IN REAL TIME

(76) Inventor: Jorge Alejandro Velez Medicis, Sarasota, FL (US)

( * ) Notice: Subject to any disclaimer, the term of this patent is extended or adjusted under 35 U.S.C. 154(b) by 0 days.

(21) Appl. No.: 12/852,460

(22) Filed: Aug. 7, 2010

(51) Int. Cl.
*G10G 7/02* (2006.01)
*G10H 5/02* (2006.01)

(52) U.S. Cl. ..... 84/454; 84/659

(58) Field of Classification Search ..... 84/454, 84/647, 653, 659
See application file for complete search history.

(56) References Cited

U.S. PATENT DOCUMENTS

| | | | | | |
|---|---|---|---|---|---|
| 4,152,964 | A * | 5/1979 | Waage | ..... | 84/675 |
| 4,498,363 | A * | 2/1985 | Shimada et al. | ..... | 84/678 |
| 5,501,130 | A * | 3/1996 | Gannon et al. | ..... | 84/454 |
| 6,121,534 | A * | 9/2000 | Brush | ..... | 84/617 |
| 7,105,734 | B2 * | 9/2006 | Tucmandl | ..... | 84/609 |
| 7,514,620 | B2 * | 4/2009 | Friedman et al. | ..... | 84/454 |
| 7,521,618 | B2 * | 4/2009 | Okuyama | ..... | 84/454 |
| 2001/0037196 | A1 * | 11/2001 | Iwamoto | ..... | 704/207 |

* cited by examiner

*Primary Examiner* — Jeffrey Donels
(74) *Attorney, Agent, or Firm* — Cionca Law Group P.C.; Marin Cionca, Esq.

(57) ABSTRACT

The present invention concerns itself with methods and systems for just intonation tuning of a digital/electrical piano in real time. A simple and economical solution is presented, which makes use of a PLC (i.e., Programmable Logic Controller), having 13 inputs (an octave plus one input for the pedal) and 22 outputs (22 possible frequencies per octave), relays, and parallel connections between octaves and PLC inputs, as well as, between PLC outputs and relays.

5 Claims, 5 Drawing Sheets

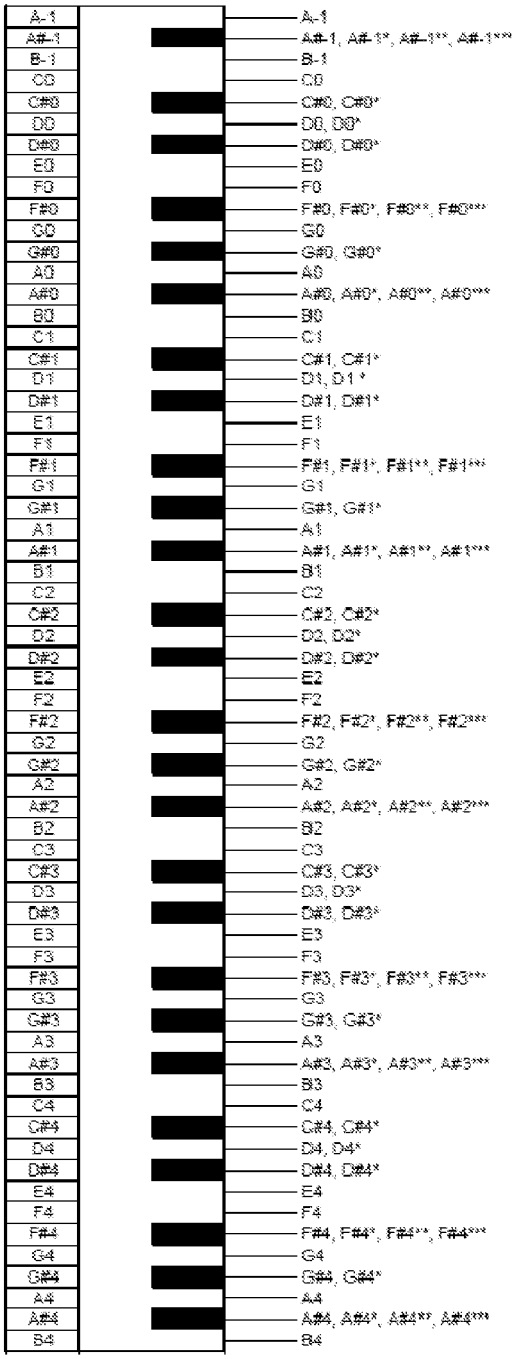
FIG. 3a (Cont'd on next sheet)
| | | | | |
|---|---|---|---|---|
| A-1 | 27.500 | | | |
| A#-1, A#-1*, A#-1**, A#-1*** | 29.333 | 29.708 | 28.646 | 29.004 |
| B-1 | 30.938 | | | |
| C0 | 33.000 | | | |
| C#0, C#0* | 34.375 | 35.200 | | |
| D0, D0* | 36.667 | 37.125 | | |
| D#0, D#0* | 38.672 | 39.600 | | |
| E0 | 41.250 | | | |
| F0 | 44.000 | | | |
| F#0, F#0*, F#0**, F#0*** | 45.833 | 47.520 | 46.406 | 46.533 |
| G0 | 49.500 | | | |
| G#0, G#0* | 51.563 | 52.800 | | |
| A0 | 55.000 | | | |
| A#0, A#0*, A#0**, A#0*** | 58.667 | 59.400 | 57.291 | 58.008 |
| B0 | 61.875 | | | |
| C1 | 66.000 | | | |
| C#1, C#1* | 68.750 | 70.400 | | |
| D1, D1* | 73.333 | 74.250 | | |
| D#1, D#1* | 77.344 | 79.200 | | |
| E1 | 82.500 | | | |
| F1 | 88.000 | | | |
| F#1, F#1*, F#1**, F#1*** | 91.667 | 95.040 | 92.813 | 93.867 |
| G1 | 99.000 | | | |
| G#1, G#1* | 103.125 | 105.600 | | |
| A1 | 110.000 | | | |
| A#1, A#1*, A#1**, A#1*** | 117.333 | 118.800 | 114.583 | 116.016 |
| B1 | 123.750 | | | |
| C2 | 132.000 | | | |
| C#2, C#2* | 137.500 | 140.800 | | |
| D2, D2* | 146.667 | 148.500 | | |
| D#2, D#2* | 154.688 | 158.400 | | |
| E2 | 165.000 | | | |
| F2 | 176.000 | | | |
| F#2, F#2*, F#2**, F#2*** | 183.333 | 190.080 | 185.625 | 187.733 |
| G2 | 198.000 | | | |
| G#2, G#2* | 206.250 | 211.200 | | |
| A2 | 220.000 | | | |
| A#2, A#2*, A#2**, A#2*** | 234.667 | 237.600 | 229.165 | 232.031 |
| B2 | 247.500 | | | |
| C3 | 264.000 | | | |
| C#3, C#3* | 275.000 | 281.600 | | |
| D3, D3* | 293.333 | 297.000 | | |
| D#3, D#3* | 308.375 | 316.800 | | |
| E3 | 330.000 | | | |
| F3 | 352.000 | | | |
| F#3, F#3*, F#3**, F#3*** | 366.667 | 380.160 | 371.250 | 375.467 |
| G3 | 396.000 | | | |
| G#3, G#3* | 412.500 | 422.400 | | |
| A3 | 440.000 | | | |
| A#3, A#3*, A#3**, A#3*** | 469.333 | 475.200 | 458.330 | 464.063 |
| B3 | 495.000 | | | |
| C4 | 528.000 | | | |
| C#4, C#4* | 550.000 | 563.200 | | |
| D4, D4* | 586.667 | 594.000 | | |
| D#4, D#4* | 618.750 | 633.600 | | |
| E4 | 660.000 | | | |
| F4 | 704.000 | | | |
| F#4, F#4*, F#4**, F#4*** | 733.333 | 760.320 | 742.500 | 750.933 |
| G4 | 792.000 | | | |
| G#4, G#4* | 825.000 | 844.800 | | |
| A4 | 880.000 | | | |
| A#4, A#4*, A#4**, A#4*** | 936.667 | 950.400 | 916.660 | 928.125 |
| B4 | 990.000 | | | |
FIG. 3b (Cont'd on next sheet)

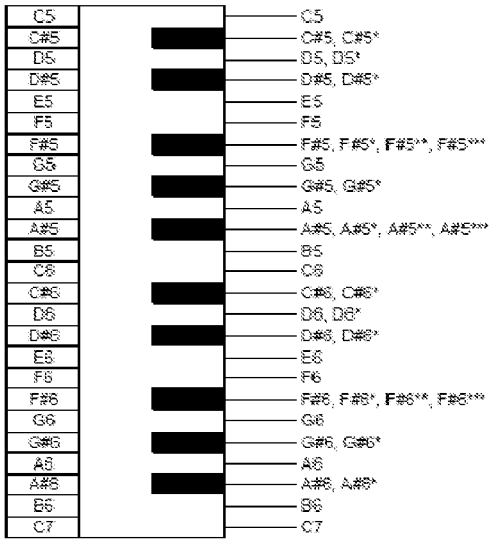
| | | | | |
|---|---|---|---|---|
| C5 | 1056.000 | | | |
| C#5, C#5* | 1100.000 | 1126.400 | | |
| D5, D5* | 1173.333 | 1188.000 | | |
| D#5, D#5* | 1237.500 | 1267.200 | | |
| E5 | 1320.000 | | | |
| F5 | 1408.000 | | | |
| F#5, F#5*, F#5**, F#5*** | 1466.667 | 1520.640 | 1485.000 | 1501.667 |
| G5 | 1584.000 | | | |
| G#5, G#5* | 1650.000 | 1689.600 | | |
| A5 | 1760.000 | | | |
| A#5, A#5*, A#5**, A#5*** | 1877.333 | 1900.800 | 1833.320 | 1856.250 |
| B5 | 1980.000 | | | |
| C6 | 2112.000 | | | |
| C#6, C#6* | 2200.000 | 2252.800 | | |
| D6, D6* | 2348.666 | 2376.000 | | |
| D#6, D#6* | 2475.000 | 2534.400 | | |
| E6 | 2640.000 | | | |
| F6 | 2816.000 | | | |
| F#6, F#6*, F#6**, F#6*** | 2933.333 | 3041.280 | 2970.000 | 3003.733 |
| G6 | 3168.000 | | | |
| G#6, G#6* | 3300.000 | 3379.200 | | |
| A6 | 3520.000 | | | |
| A#6, A#6*, A#6**, A#6*** | 3754.666 | 3801.600 | 3666.640 | 3712.500 |
| B6 | 3960.000 | | | |
| C7 | 4224.000 | | | |
FIG. 3a (Cont'd from sheet 4)
FIG. 3b (Cont'd from sheet 4)

METHOD AND SYSTEM TO HARMONICALLY TUNE (JUST INTONATION TUNING) A DIGITAL / ELECTRIC PIANO IN REAL TIME

BACKGROUND OF THE INVENTION

1. Field of the Invention

The present invention relates generally to piano tuning and particularly to digital/electric just intonation tuning in real time.

2. Description of the Related Art

Pianos are impossible to be tuned harmonically. They are always slightly out of tune. Different approaches have been put forward but none have been able to make all the notes completely sound in tune at the same time. The presently used in the art tuning method (i.e., equal temperament) distributes the inharmonicity evenly throughout the musical scale making pianos sound always out of tune which can be heard in the form of beats when two or more notes are played.

While giving a solution to mechanical pianos is unpractical, if not impossible, a solution to this problem on digital/electric pianos is viable. By the use of a processor and a program with a set of logic instructions to determine, really fast (i.e., in the range of a few milliseconds) appropriate tones (i.e., frequencies), that would yield a harmonic ratio between keys being played, real time harmonic tuning of a digital/electric piano may be achieved.

Approaches for tuning a digital piano, including real time and just intonation tuning, are known in the art to overcome the out-of-tune problem. For example, applicant is aware of U.S. Pat. No. 5,501,130 issued on Mar. 26, 1996 to Gannon, et al., which describes an apparatus for adjusting the tuning of a musical instrument to cause the instrument to sound in just intonation while the instrument is being played. The apparatus comprises a data base in memory for storing an array of just intonation tone identifiers. The tone identifiers in the array are arranged by key, chordal root and tone according to just intonation relationships defined by the ratios of a scale selected by the musician. A selector unit is provided for enabling a musician to select a key and/or a chordal root, as a result of which a CPU retrieves from the array a set of tone identifiers in just intonation corresponding to the selected key or chordal root and transmits them to the sounding means of the instrument.

Applicant is further aware of U.S. Pat. No. 4,152,964 issued on May 8, 1979 to Waage, which describes a keyboard controlled just intonation computer for electronic organs which automatically responds to correct the larger tuning errors of equal temperament as each interval or chord is played. The logic circuit for this purpose has twelve inputs corresponding to the twelve notes of the chromatic scale. When the logic circuit is turned off the instrument remains tuned to equal temperament.

Applicant is also aware of U.S. Pat. No. 7,105,734 issued on Sep. 12, 2006 to Tucmandl, which describes the use of a sound sample library storage unit. In order to manage the sound samples stored in the above-mentioned storage unit, a bidirectional sound parameter storage unit is provided, which is bidirectional or multidirectional data-flow and data-exchange connected at least to the processor unit and to the sequencer. Each of the sound samples stored in the sound sample storage unit are assigned to said bidirectional sound parameter storage unit, which contains sound definition parameters enabling access to sound samples.

Applicant is also aware of U.S. Pat. No. 7,514,620 issued on Apr. 7, 2009 to Friedman, legal representative, which describes a method and apparatus for shifting pitches of audio signals to achieve desired pitch relationships between the audio signals. The audio signals may be in either a digital or analog format. One of the input audio signals is selected to be a reference signal. For each of the other audio signals, the pitch of the other audio signal is compared with the pitch of the reference signal to determine a relative pitch relationship. For each of the other signals, an adjustment is determined to bring the relationship to a desired pitch relationship. Based on the adjustment, the pitch of at least one of the audio signals is adjusted to achieve the desired pitch relationship between the audio signals. The desired pitch relationship between the pitch of the reference signal and the pitch of the audio signal other than the reference signal may be based on a just intonation.

Applicant is also aware of U.S. Pat. Appl. No. 20010037196 published on Nov. 1, 2001, which describes an apparatus for generating an additional sound signal on the basis of an input sound signal, which comprises: an input device adapted to receive control information for controlling a pitch of an additional sound; and a processor device coupled with the input device. The processor device is adapted to: obtain pitch information of the input sound signal; obtain scale note pitch information of an additional sound to be generated; determine a scale note pitch nearest to a pitch indicated by the pitch information of the input sound signal; modify the additional sound to be generated; and generate an additional sound signal with the modified pitch.

The problem with the prior art is that the approaches it describes are really complex and unpractical solutions to the very challenging problem presented here. To illustrate, it may be worth noting that the applicant has not seen a just intonated piano in stores yet. Thus, an unaddressed need for a simplified, and therefore practical, solution to this problem exists. As it will be later described herein, the use of parallel connections between octaves, PLC (i.e., Programmable Logic Controller) and relays, and the use of other simplifying approaches, can overcome the inadequacies and deficiencies of the prior art.

The problems and the associated solutions presented in this section could be or could have been pursued, but they are not necessarily approaches that have been previously conceived or pursued. Therefore, unless otherwise indicated, it should not be assumed that any of the approaches presented in this section qualify as prior art merely by virtue of their presence in this section of the application.

BRIEF SUMMARY OF THE INVENTION

It is an object of the present invention to use a PLC (i.e., Programmable Logic Controller) for the purpose of determining which frequencies from a list of frequencies (22 per octave) would yield a harmonic ratio based on keys of a digital/electric piano being played. Said PLC is configured with 13 inputs and 22 outputs. The 22 tones (frequencies) per octave are pre-recorded (sampled) within the digital/electric piano.

It is another object of the present invention to provide a real-time tuning solution by ensuring that when keys are played, the ones that can have different frequencies (there are 6 notes per octave that will not vary), will "play" all the different frequencies at the same time, but only the one determined by the PLC will actually be put through to the speaker. This is very important as it lets the piano to be tuned in real time. For example, if a note is played first by itself, it will sound a determined frequency, but if, while it is being pressed, a second or more keys are played, the tune (frequency) of the first note and/or the subsequent note(s) will be adjusted accordingly in real time by the opening and closing of relays.

It is another object of the present invention to use relays to close the circuit path for the frequencies to be put through the speaker and therefore be heard.

It is another object of the present invention to connect in parallel all the octaves in the piano (i.e., their signals to the PLC and the signals from the PLC to their relays). If a determined note is played, for example C2, the PLC would receive the same input signal as if notes CO, C1, C3, C4, C5, C6, and C7 would have been pressed, and in turn the output signal from the PLC will be sent to all relays located on CO, C1, C2, C3, C4, C5, C6, C7 at the same time (see more details below). This is really important as it makes possible the use of only one PLC for the complete piano, thus making the implementation of the invention inexpensive and therefore economically viable. This is also why the PLC will only need to have 13 inputs (an octave plus one input for the pedal) and 22 outputs (22 possible frequencies per octave).

BRIEF DESCRIPTION OF THE DRAWINGS

For exemplification purposes, and not for limitation purposes, embodiments of the invention are illustrated in the figures of the accompanying drawings, in which:

FIG. 3*a* and FIG. 3*b* show a sample keyboard with each octave (12 keys) being associated with 22 tones/frequencies, in accordance with several embodiments of the present invention.

DETAILED DESCRIPTION OF THE INVENTION

Figure 1:
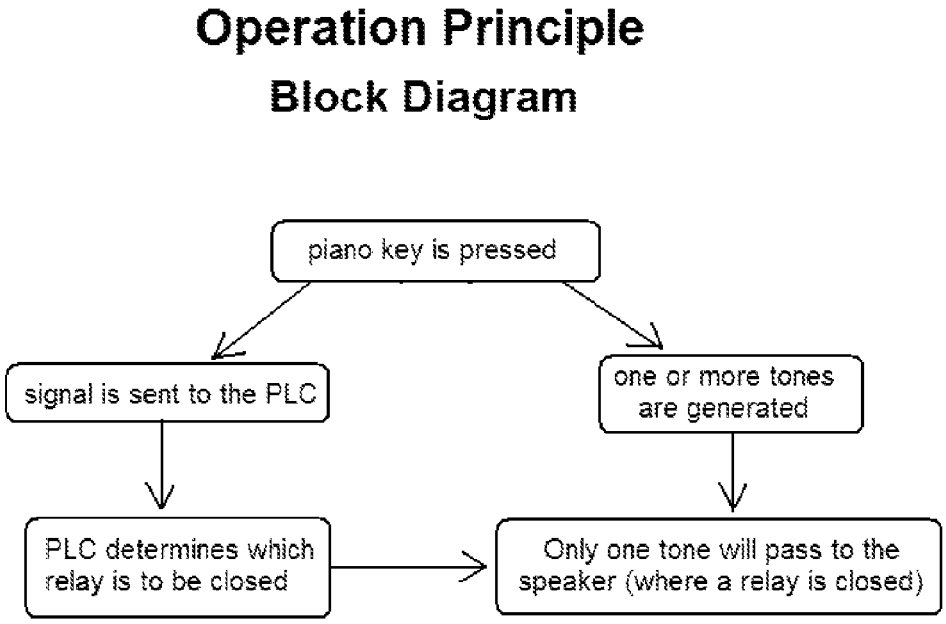
FIG. 1 is a block diagram illustrating the operational principle of the present invention, in accordance with several embodiments of the present invention.

What follows is a detailed description of specific embodiments of the invention in which the invention may be practiced. Reference will be made to the attached drawings, and the information included in the drawings is part of this detailed description. The specific embodiments of the invention, which will be described herein, are presented for exemplification purposes, and not for limitation purposes. It should be understood that structural and/or logical modifications could be made by someone of ordinary skills in the art without departing from the scope of the present invention. Therefore, the scope of the present invention is defined only by the accompanying claims and their equivalents.

As used in this specification and in the appended claims, the term "electrical piano" means a piano that is either electrical or digital or both.

According to an embodiment of the present invention, a digital/electric piano will have pre-recorded (sampled) sounds, with pitches established as per the attached frequencies list (FIG. 3*b*). These sounds (frequencies) have been calculated using the following ratios:

| |
|---|
| 16/15 |
| 10/9 |
| 9/8 |
| 6/5 |
| 5/4 |
| 4/3 |
| 45/32 |
| 64/45 |
| 3/2 |
| 8/5 |
| 5/3 |
| 7/4 |
| 16/9 |
| 9/5 |
| 15/8 |

By using the above ratios, harmonic relationships are established between different notes (just intonation tuning). It can also be observed from the frequencies list (FIG. 3*b*) that notes C, E, F, G, A, and B can only have one possible sound (frequency), notes C#, D, D#, and G# can have two possible sounds (frequencies), and notes F# and A# can have four possible sounds (frequencies). This has been determined with the goal of always reproducing harmonic chords for any notes being played at any given moment. This is accomplished by only letting those particular frequencies that yield a harmonic ratio, be heard on the piano speakers.

Figure 2:
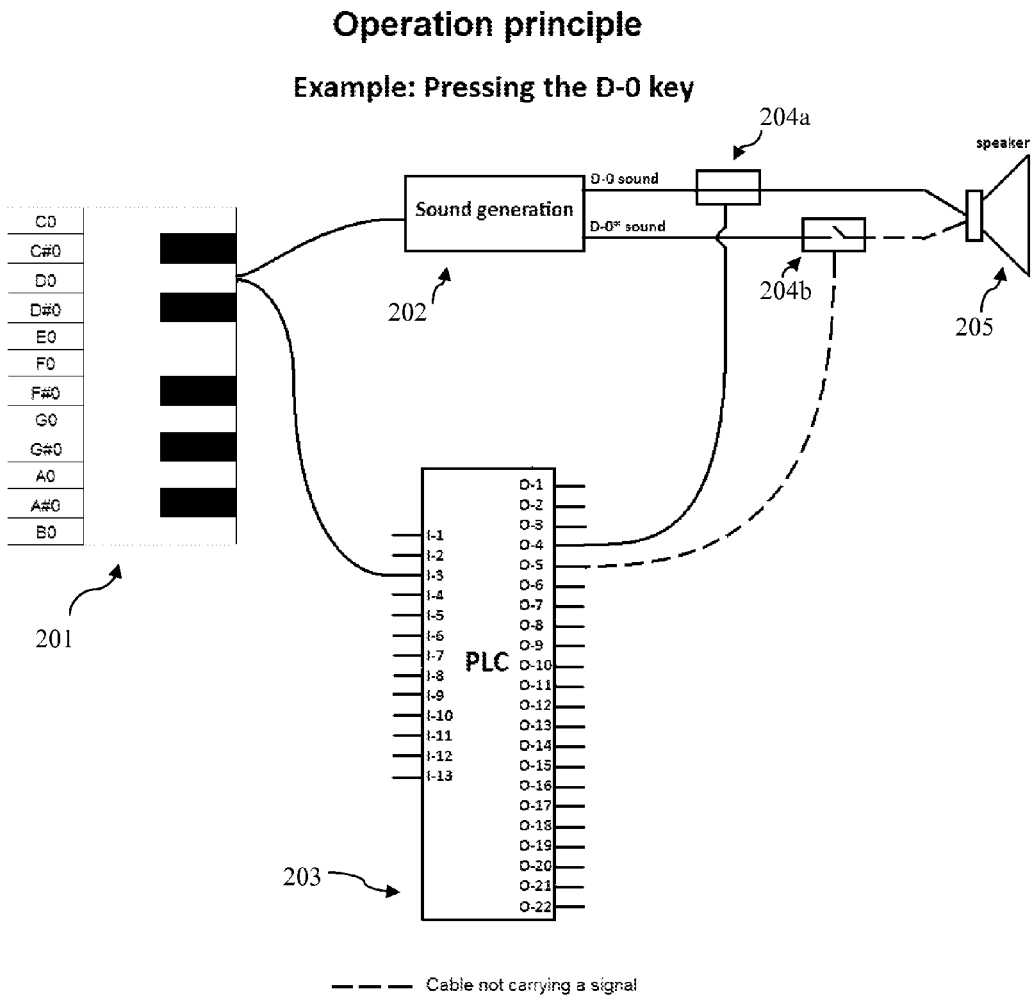
FIG. 2 shows an example of the operational principle when D-0 key is pressed; herein, through electrical wires, the keyboard 201 (partial view) connects to the sound generation system 202 of a digital/electric piano and to the PLC 203; furthermore, the sound generation system 202 and the PLC 203 connect to relays 204*a* and 204*b*, which connect to speaker 205, in accordance with several embodiments of the present invention.

Controlling the opening and closing of the circuit paths for sounds to be heard or muted is done by a PLC (i.e., Programmable Logic Controller) as illustrated in FIG. 2. Through a logic program, the PLC 203 monitors the keys being played through signals sent from electric contacts installed on each piano key. These contacts may act upon the action of the key being completely struck, or (if it should be found that additional time is required for the PLC calculations) these contacts may as well activate when the key is partially struck (for example at a ¾ of the travel). Then, the PLC's program determines which outputs are to be energized; these outputs in turn close electric relays 204*a* and 204*b* (FIG. 2) installed between the sound generation system 202 of the piano and the speakers 205, therefore only letting pass sound where relays are closed (otherwise normally open).

The PLC 203 has 13 inputs, which correspond to one octave of the piano (12 notes/keys) and one input for the sustain pedal. An input for the sustain pedal is necessary so that the PLC program knows the sound is still being played after the key has been released. Given that there are only 12 different notes in a piano (i.e., any subsequent octaves are composed by the same notes only double the frequency), the PLC 203 will be monitoring all the octaves in the piano by connecting the octaves to the PLC inputs in parallel (see FIG. 2*a*). On the other hand, the PLC has 22 outputs, which correspond to the 22 different possible sounds in one octave as determined by the attached frequencies list (FIG. 3*b*). The 22 sounds were carefully calculated and chosen in order to achieve the ultimate goal of real time tuning with a minimum number of sounds. This is important because, a larger number of sounds/frequencies requires a larger number of relays, wires, and PLC outputs, and a more sophisticated PLC program, and therefore, the implementation of the invention would become more difficult with a larger number of sounds/frequencies per octave. However, it is to be understood that while the use of 22 sounds/frequencies, as seen in FIG. 3*b*, is preferred, the use of a larger number of sounds/frequencies would not depart from the scope of the present invention.

The 22 PLC outputs will also be connected in parallel (see FIG. 2*a*) to the 22 relays per octave (the total number of relays will be equal with 22 times the number of octaves the respective piano has). Therefore only one PLC is used, both, to monitor and to actuate all the different octaves in the piano at the same time. Again, this is really important as it makes possible the use of only one PLC for the complete piano, thus making the implementation of the invention physically possible, given the limited space available, inexpensive and, therefore, economically viable. One of ordinary skills in the art would recognize that, while economically disfavored, a choice could be made to use two or more PLCs, without departing from the scope of the present invention.

Figure 2A:
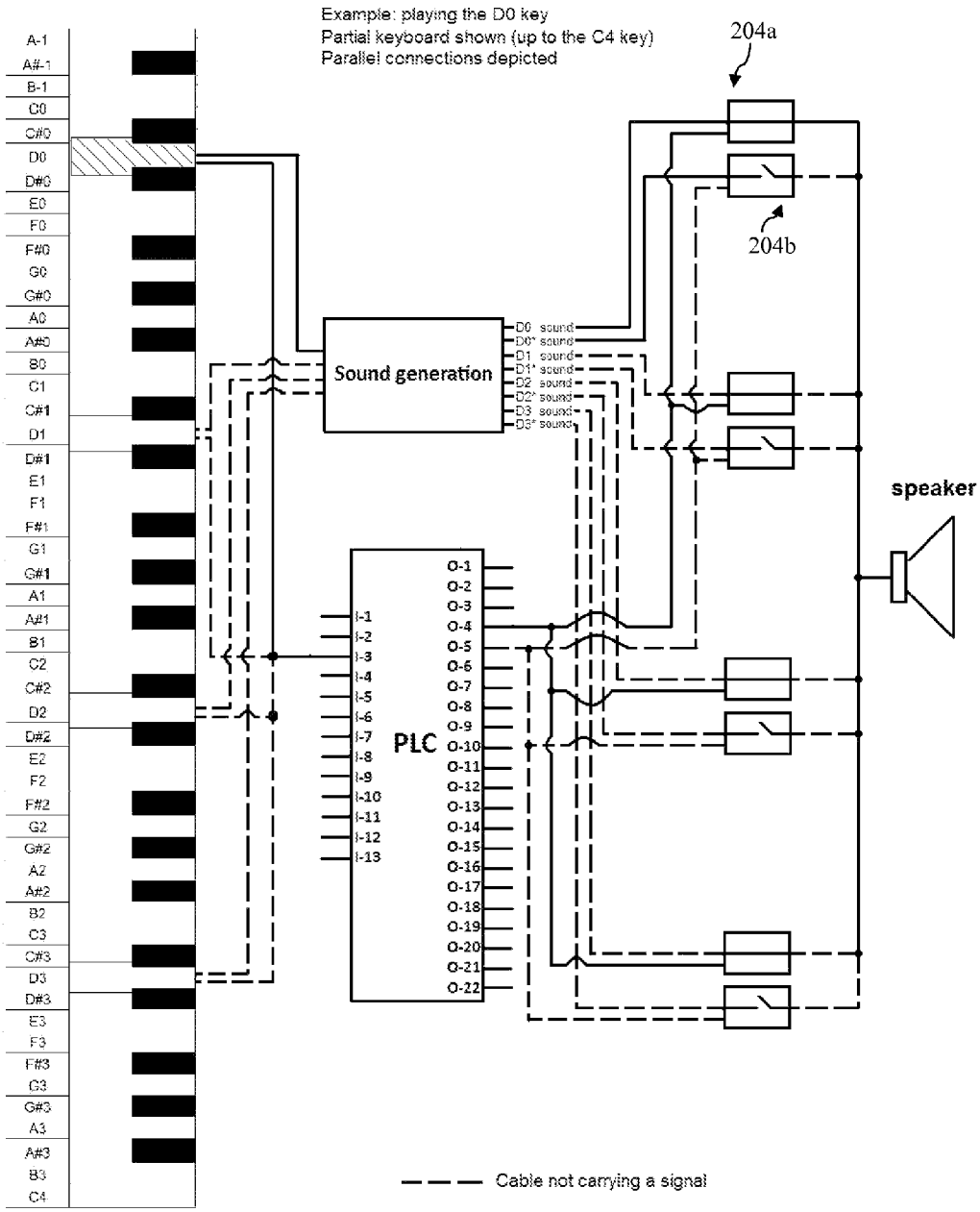
FIG. 2*a* depicts the parallel connections between the keyboard (partial view) of a digital/electrical piano, PLC and relays, in accordance with several embodiments of the present invention.

As seen in FIGS. 2 and 2*a*, the PLC 203 is independent from the generation of sounds, which is carried on within the sound generation system 202 of the piano. Therefore, when a key is played (e.g., D-0), even though, because of the parallel connections described earlier, all the relays for that same key on all the different octaves (i.e., D-0, D-1, D-2, and so on), will be closed by the PLC, only the sound for that particular key being played (D-0 in this example) will actually be heard. This is because the sound generation system 202 is only generating sounds (i.e., two sounds, D-0 and D-0* in this example) for that particular key being struck (D-0 in this example), and because of the two corresponding relays, 204*a*/D-0 and 204*b*/D-0*, only the 204*a*/D-0 relay will be actually closed by the PLC; hence, only the D-0 sound will reach the speaker 205.

Obviously, the PLC may open the relays for D-0, D-1, D-2, and so on, and close the relays for D-0*, D-1*, D-2* and so on, and therefore, allow the D-0* sound to be heard, instead of the D-0 sound, when, for example, a second and/or a third note is being played and the PLC program determines that D-0* would sound harmoniously with such second, third and so on, note. In this way, the real time tuning of the piano is achieved. The real time tuning may be achieved by the PLC by changing the sound/frequency of the first key/note played (i.e., D-0 to D-0* in this example) and/or by choosing a harmonious sound/frequency for the subsequently played key (s) if such key(s) has/have more than one sound/frequency (see FIG. 3*b*).

Although specific embodiments have been illustrated and described herein for the purpose of disclosing the preferred embodiments, someone of ordinary skills in the art will easily detect alternate embodiments and/or equivalent variations, which may be capable of achieving the same results, and which may be substituted for the specific embodiments illustrated and described herein without departing from the scope of the present invention. Therefore, the scope of this application is intended to cover alternate embodiments and/or equivalent variations of the specific embodiments illustrated and/or described herein. Hence, the scope of the present invention is defined only by the accompanying claims and their equivalents.

What is claimed is:

1. An apparatus for the just intonation tuning of an electrical piano in real time comprising:

a sound generation system that generates all the sound signals predetermined to be associated with each of the keys of the electrical piano, when the keys are pressed;

one PLC that monitors the keys being pressed, and that is programmed to determine which sound signal from all the generated sound signals for each key being pressed is allowed to travel to the electrical piano's speakers so that the sounds played by the speakers at any time are in just intonation;

a plurality of relays controlled by the said PLC and mounted in the path between said sound generation system and said speakers, whereby, closed relays physically permit the traveling of the sound signals to the speakers; and, parallel connections between the piano's octaves and the PLC's inputs, and, between the PLC's outputs and said relays, whereby, real time tuning of the entire piano using only one PLC is achieved.

2. The apparatus of claim 1, wherein said PLC has thirteen inputs and twenty two outputs.

3. A method for achieving just intonation tuning of an electrical piano in real time comprising, in any order, the steps of:

connecting in parallel the piano octaves' keys to a PLC's inputs, and, said PLC's outputs to a plurality of relays mounted in the path between the piano's sound generation system and the piano's speakers; and configuring said PLC to select, from all of the sound signals predetermined to be generated by the sound generation system for each of the keys of the piano, only one sound signal for each key being pressed, and to allow selected sound signals to travel to the speakers, by closing associated relays, so that the sounds that are played by the speakers at any time are in just intonation.

4. The method of claim 3, wherein the said PLC has thirteen inputs and twenty two outputs.

5. A method for achieving just intonation tuning of an electrical piano in real time comprising, in any order, the steps of:

connecting in parallel the piano octaves' keys to a PLC's inputs, and, said PLC's outputs to a plurality of relays mounted in the path between the piano's sound generation system and the piano's speakers;

determining twenty two different sounds for each octave of the piano and pre-recording said sounds in said sound generation system; and configuring said PLC to select from the pre-recorded sounds only one sound for each of the piano's keys being actuated, and to allow the sound signals for the selected sounds to travel to the speakers, by closing associated relays, so that the sounds that are played by the speakers at any time are in just intonation.

* * * * *